United States Patent [19]

Ridley

[11] 3,940,119

[45] Feb. 24, 1976

[54] ROTOR GUN FOR THE AIR PLACEMENT OF GRANULAR AND CEMENTITIOUS MATERIALS

[76] Inventor: Ian M. Ridley, 34 Azalea Court, Plainview, N.Y. 11803

[22] Filed: June 6, 1974

[21] Appl. No.: 477,155

[52] U.S. Cl. ..... 259/151; 302/49; 302/56

[51] Int. Cl.[2] ..... B28C 5/06

[58] Field of Search ..... 259/151, 147, 158, 169, 259/170, 161, 2, 40, 41, 42, 45, 46; 302/56, 52, 49

[56] References Cited

UNITED STATES PATENTS

| | | | |
|---|---|---|---|
| 1,221,080 | 4/1917 | Murray | 302/49 |
| 2,299,565 | 10/1942 | Colburn | 302/49 |
| 2,314,031 | 3/1943 | Colburn | 302/49 |
| 2,637,539 | 5/1953 | Crom | 259/147 |
| 3,672,646 | 6/1972 | Burtin | 259/151 |

*Primary Examiner*—Robert W. Jenkins

[57] ABSTRACT

Rotor gun means for the air placement of granular and cementitious material. A mixing chamber for granular and cementitious materials, has a rotor gun mounted therein. The rotor gun comprises a motor driven wheel having a plurality of holes or apertures equally spaced about said rotor wheel. The apertures pick up the material and pass in front of a source of high pressure air stream which blows the material from the apertures.

2 Claims, 4 Drawing Figures

ROTOR GUN FOR THE AIR PLACEMENT OF GRANULAR AND CEMENTITIOUS MATERIALS

This invention relates to cement guns and more particularly to a cement gun employing a rotor wheel to feed granular and cementitious materials to an air blast.

Conventional cement guns generally comprise a pressurized chamber from which the granular and cementitious material is blown by air pressure. These guns are subject to clogging and building up of the material on the interior surfaces and passage ways of the apparatus especially if the material has a relatively high moisture content.

The present invention provides a positive feeding of the material into the air blast by means of a rotor wheel having a plurality of holes or apertures spaced around its periphery. The rotor wheel feeds the material by filling the apertures and passing them in front of the air blast. Control switch means are provided at the nozzle end so that the air blast may be delivered alone for cleaning purposes, or in combination with the material. Accordingly, a principal object of the invention is to provide new and improved cement gun means.

Another object of the invention is to provide new and improved cement gun means having a rotor wheel connected to deliver granular and cementitious materials into the air blast.

Another object of the invention is to provide new and improved cement gun means having a rotor wheel connected to deliver the granular material into the air blast wherein the granular material is not passed around corners or angles in passage ways.

Another object of the invention is to provide cement guns having a rotor feed for the granular material wherein the rotor is slip-fitted to the drive shaft and the rotor is positioned by means of sealing pads having adjustable pressure means connected thereto.

These and other objects of the invention will be apparent from the following specification and drawings, of which:

Figure 1:
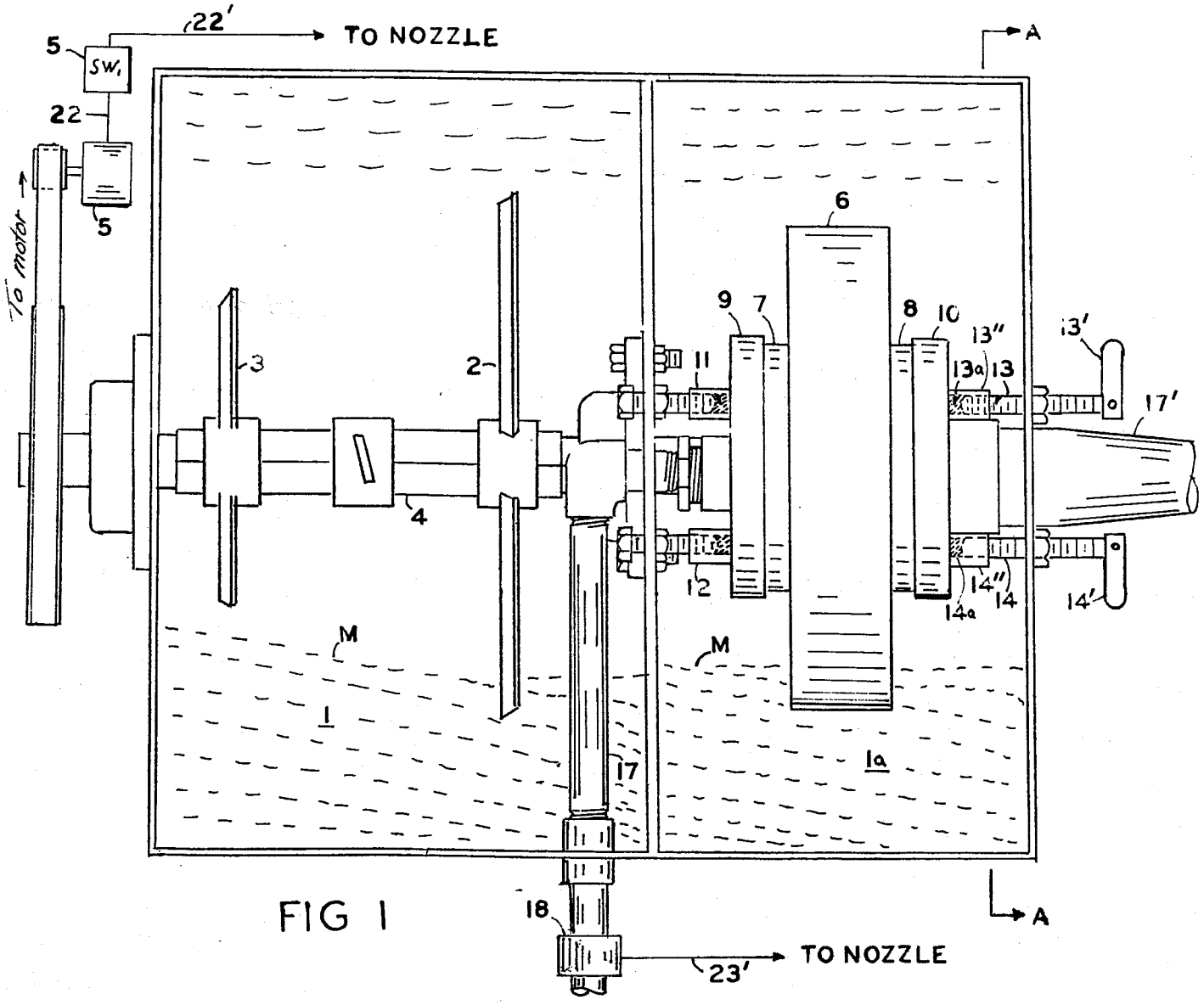
FIG. 1 is a top view of an embodiment of the invention.
Figure 2:
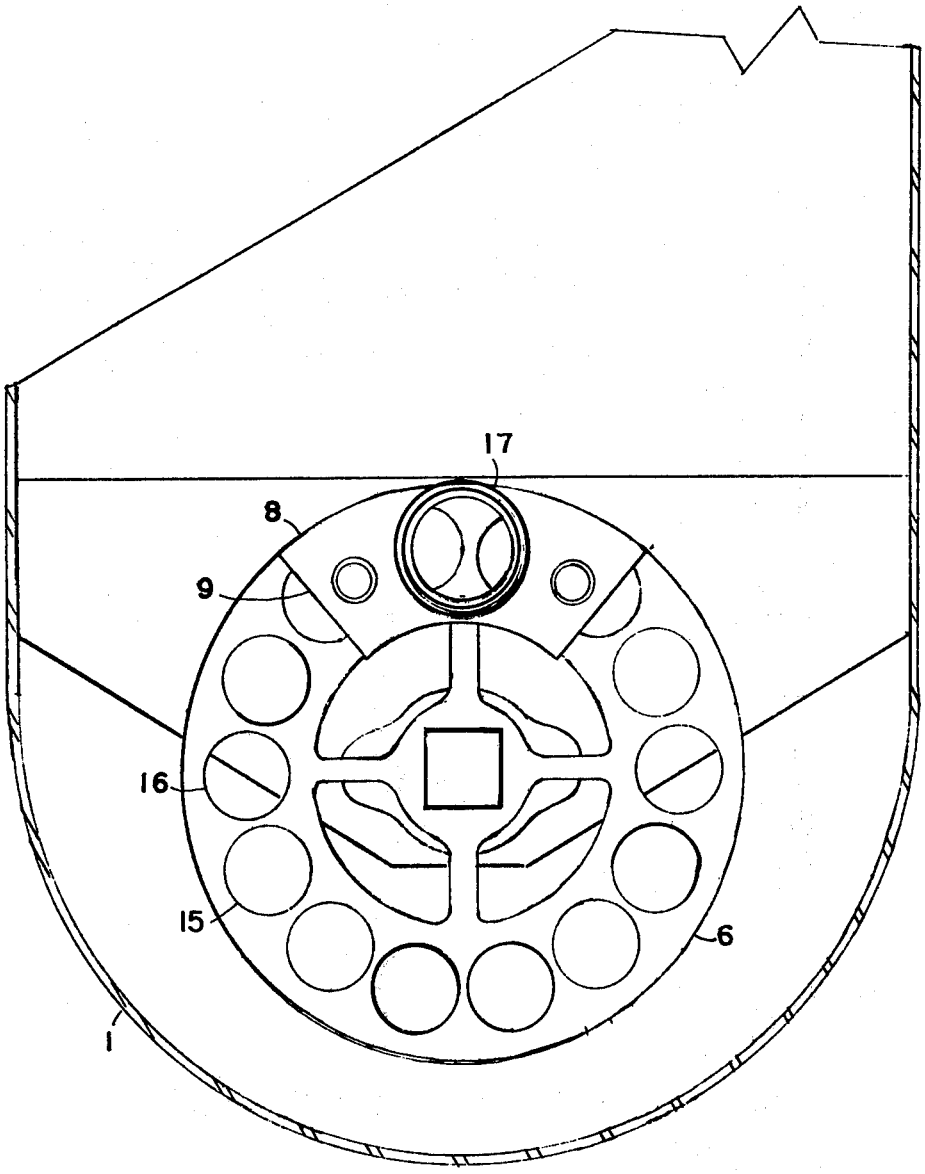
FIG. 2 is a sectional view along the lines 2—2 of FIG. 1.

Referring to the figures, the invention comprises a mixing chamber 1, into which are fed the granular and cementitious materials. The materials are mixed and fed to the right in FIG. 1 by means of the mixing blades 2 and 3, which are mounted on the shaft 4, which is connected to be driven by the motor 5.

The solid material M is moved by the blades 2 and 3 into the gun section 1a of chamber 1. In the chamber 1a, the rotor wheel is mounted on the shaft 4. The shaft 4 is preferably square in cross-section and the rotor wheel has a corresponding square hub aperture. The rotor wheel 6 is held in place in the axial direction of the shaft by means of rubber pressure pads 7 and 8, which are held in place by steel plates 9 and 10. The steel plates 9 and 10 are adjustably held in place by means of the adjustable screw mountings, 11, 12, 13 and 14. The last two screw mountings are adjustable by means of the handles 13' and 14'. The purpose of the pressure adjustments are to hold the rotor in place with a desired amount of pressure and provide a good seal for the air blast stream.

The rotor picks up the material M in the holes or apertures 15, 16, etc., which extend through the rotor wheel and carries the material up between the pads 7 and 8 and into registration with the high pressure air pipe 17, which is connected to a source of high pressure air through the valve 18. The high pressure air blows the material from the apertures in the rotor, into the exit pipe 17', which is connected to a hose 19, which delivers the solid material to the nozzle 20, where the granular and cementitious material is mixed with water, fed through the adjustable valve 21, in conventional manner. The mixture is then sprayed onto the work location thereby depositing a cement layer at the work location which may be, for instance, a swimming pool or other wall. In one embodiment the holes or apertures in the rotor were 2⅜ inches in diameter.

Figure 4:
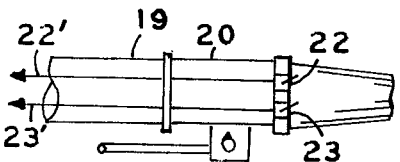
FIG. 4 is a detail view of the feeding nozzle.
Figure 3:
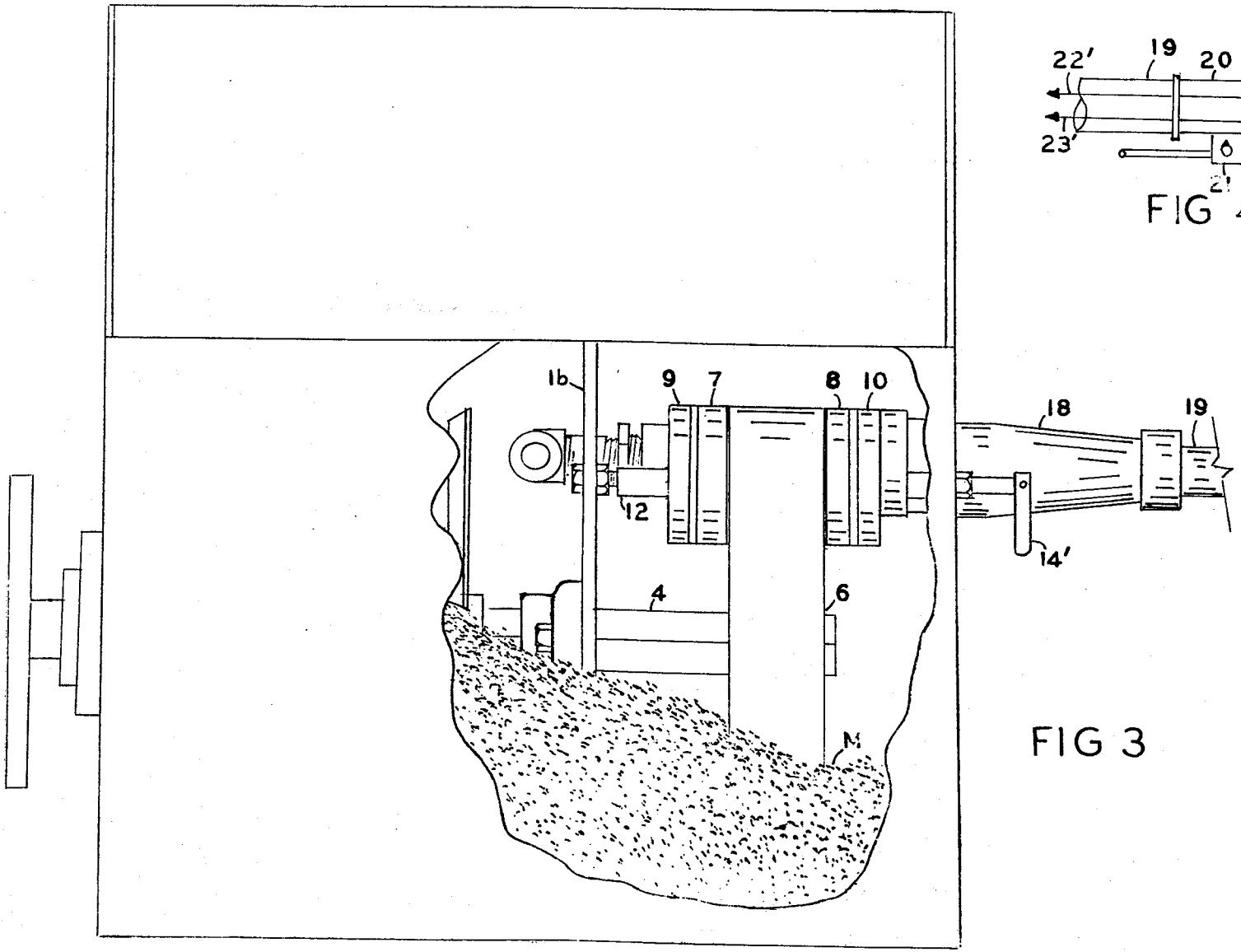
FIG. 3 is a side view of the embodiment of FIG. 1.

Referring to FIG. 4, mounted on the nozzle are a pair of switches 22 and 23. The switch 22 is connected by wire 22', to operate the motor 5, which controls the operation of the rotor wheel and the switch 23 is connected by wire 23', to operate the valve 18, which controls the high pressure air. Therefore, if desired, high pressure air only, may be fed for the purpose of blasting and cleaning the work surface. When it is desired to feed the material mixture, then the switch 22 is operated.

The operation of the machine is as follows:

1. Appropriate material is placed at the far end of the mixer away from the rotor and the mixer motor started.
2. The mixer blades blend the materials and propel them along the mixer until they reach the rotor.
3. When sufficient materials have been mixed to start the delivery phase, the air is turned on and as each hole in the rotor picks up its load of material and passes into the air lock created by the two rubber seal pads pressing against the rotor from opposite sides, the material is blown out of the rotor and into the discharge hose as each pocket passes through the air lock area. The rubber pads may have a steel core for strength.

At the delivery end of the discharge hose at the nozzle are located low-voltage electrical switches which operate the motor and the compressed air. The nozzle operator can turn on the air stream separately from the material and thus use the air to blow debris away from the area where the material is placed. The air will pass through the stationary rotor. The operator has full control of the delivery of air and material.

The rotor and sealing pad assembly has been designed for very fast maintenance and changing of components. The main shaft has a bearing at the far end of the mixer where it enters the mixer and another bearing located at the partition 1b near the center of the mixer. The rotor is slipped on the squared end of the shaft in a cantilever position. The rotor is positioned on the shaft by means of the seal pads, and since the square hub of the rotor fits loosely over the squared end of the shaft with no other means to secure the rotor to the shaft, the rotor is actually floating along the shaft. When the rotor needs to be removed for service, the pressure plates and rubber seal pads are removed and the rotor slides off the shaft.

To further improve the floating action of the rotor and to make the seal pads conform easily to the surface of the rotor, the bolts 13 and 14 operating the pressure plates are loosely fitted into two tubes 13'' and 14'' fixed to the pressure plates, which tubes maintain the position of the seal pads relative to the rotor and at the bottom of these tubes are bearing points made of fairly firm rubber into which the rounded ends of the bolts press, forming thereby ball joints 13*a*, 14*a*, which can give with any fluctuation of the assembly.

The combination, therefore, of a free-floating rotor, held in place by the bearing surfaces of two, opposed rubber pads which in turn are secured in position by being fitted to steel pressure plates which in turn receive their pressure from the end of two bolts slip-fitted into appropriate tubes in the pressure plate and bearing in a ball-joint fashion on rubber pressure points located at the bottom of the tube, constitute a series of floating and rubberized connections leading to a self-aligning situation between the seal pads and the rotor as well as providing the means for quick disassembly and reassembly of the principal working parts of the apparatus.

Insofar as the operation is concerned, the salient feature is that the material blows directly out of the rotor and into a rubber-lined tube without amaking any turns. This is of utmost importance when the materials being used have excessive amounts of moisture since it is a well known fact of this industry that when materials make turns, the centrifugal force causes cementitious materials to adhere to the walls and to cause a clogging condition to occur. Other guns currently being used cause the material to make from 90° to 180° turns before entering the hose.

The main features of this invention are:

1. The straight-through all flow design.

2. The free-floating rotor slip-fitted to a shaft in a cantilevered manner.

3. The positioning of the rotor by means of the opposing pressure of the seal pads.

4. The rubber "ball joint" which evenly distributes the pressure to the pressure plates and thence to the seal pads.

5. The remote control switches at the nozzle which gives the selective operation of the air and material to the nozzle operator.

6. Since the rotor is floating on the shaft, the seal pad on the mixer side needs only one setting. All subsequent adjustments can be made from the outside by the two bolts with the swivel handles.

I claim:

1. Rotor gun means for the air placement of granular and cementitious material, comprising, a mixing chamber for granular and cementitious materials, a driven shaft mounted parallel to the bottom of said chamber, a rotor freely floating on said shaft in predetermined space relation in said mixing chamber, said rotor comprising a motor driven wheel in the central portion of said chamber, said wheel having a plurality of apertures equally spaced about said rotor wheel, said apertures being adapted to pick up said material, and a source of high pressure air stream connected to blow said material from said apertures as said apertures pass said high pressure air stream, into an outlet nozzle without any bends or turns in the path of the air stream, a pair of resilient sealing pads, said rotor wheel passing between the pair of sealing pads, and means to adjustably mount at least one of said sealing pads in place, comprising a pair of steel plates one each on the outer sides of said pads and adjustable screw operated means for adjusting the pressure of one of said plates against one of said pads.

2. Apparatus as in claim 1 wherein said rotor wheel has a square center aperture and is mounted on a square drive shaft.

* * * * *